US005480267A

United States Patent [19]

Hagenah

[11] Patent Number: 5,480,267

[45] Date of Patent: Jan. 2, 1996

[54] SET OF STRUCTURAL ELEMENTS MADE UP OF CONCRETE BLOCKS, AND A GRAVITY RETAINING WALL ERECTED THEREFROM

[75] Inventor: Gerhard Hagenah, Worpswede, Germany

[73] Assignee: SF-Kooperation GmbH Beton-Konzepte, Bremen, Germany

[21] Appl. No.: 211,118

[22] PCT Filed: Sep. 18, 1992

[86] PCT No.: PCT/EP92/02153

§ 371 Date: Aug. 16, 1994

§ 102(e) Date: Aug. 16, 1994

[87] PCT Pub. No.: WO93/06310

PCT Pub. Date: Apr. 1, 1993

[30] Foreign Application Priority Data

Sep. 20, 1991 [DE] Germany ..... 41 31 423.9

[51] Int. Cl.[6] ..... F02D 29/02

[52] U.S. Cl. ..... 405/284; 405/286; 52/605

[58] Field of Search ..... 405/262, 284, 405/285, 286, 287; 52/586.1, 586.2, 585.1, 582.1, 605, 604, 606, 607

[56] References Cited

U.S. PATENT DOCUMENTS

| | | | |
|---|---|---|---|
| 1,787,199 | 12/1930 | Huntoon . | |
| 2,392,551 | 1/1946 | Roe | 52/586.2 |
| 2,703,963 | 3/1955 | Gutierrez | 405/262 |
| 3,422,588 | 1/1969 | Stewart, Jr. . | |
| 4,324,508 | 4/1982 | Hilfiker et al. | 405/284 |
| 4,367,615 | 1/1983 | Feldman | 52/583 |
| 4,684,294 | 8/1987 | O'Neill | 405/286 |
| 4,824,293 | 4/1989 | Brown et al. | 405/284 |
| 4,957,395 | 9/1990 | Nelson | 405/287 |
| 5,191,744 | 3/1993 | Bowes | 52/606 X |

FOREIGN PATENT DOCUMENTS

| | | | |
|---|---|---|---|
| 1258423 | 3/1961 | France . | |
| 2055983 | 5/1971 | France . | |
| 2651258 | 3/1991 | France . | |
| 93232 | 10/1972 | Germany . | |
| 2755833 | 7/1978 | Germany . | |
| 2753243 | 6/1979 | Germany . | |
| 3507531 | 9/1986 | Germany . | |
| 3913335 | 10/1990 | Germany . | |
| 3917500 | 12/1990 | Germany . | |
| 9015196 | 4/1991 | Germany . | |
| 727767 | 4/1980 | U.S.S.R. . | |
| 1011793 | 4/1983 | U.S.S.R. . | |
| 1064451 | 4/1967 | United Kingdom . | |
| 1332297 | 10/1973 | United Kingdom . | |
| 8503535 | 8/1985 | WIPO | 405/284 |
| WO8802050 | 3/1988 | WIPO . | |

OTHER PUBLICATIONS

DE–Z: Betonwerk umnd Fertigteiltechnik H.5, 1990, S.100 u.102.

*Primary Examiner*—Dennis L. Taylor
*Assistant Examiner*—Frederick L. Lagman
*Attorney, Agent, or Firm*—Sughrue, Mion, Zinn, Macpeak & Seas

[57] ABSTRACT

Known sets of structural elements have blocks with depressions and cross-shaped, T-shaped or Z-shaped connecting pieces which come to be located therein. Only retaining walls which are oriented in a straight line can be constructed.

The set of structural elements according to the invention has, in addition to blocks with depressions, coupling pieces with at least a part thereof being in the form of a truncated cone, with corresponding cross-sectional shape of the depression. In this manner, a rotation of blocks, in particular located one above the other, is possible. Curved retaining walls can thus be erected.

25 Claims, 10 Drawing Sheets

Figure 1:
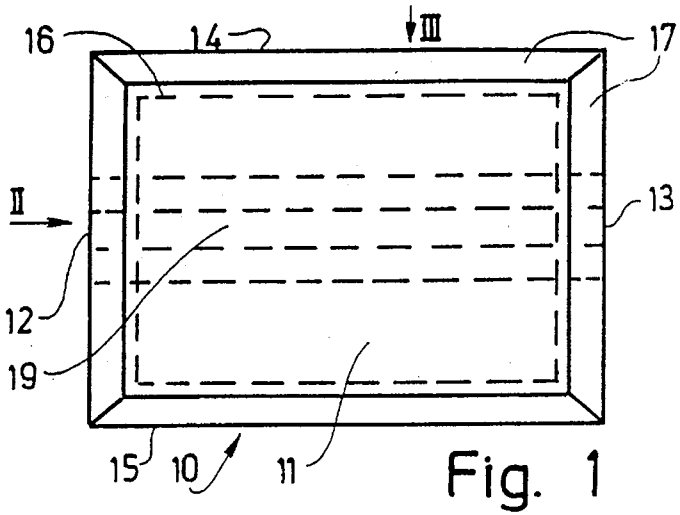

VIb
VIc
23
21
23 d 23
21

23 d
21
23 e
23e 23
23 b
21

Vb
Vc
Vd
23
23c
21

23
21

23 b
23a
23 b
23a
23c
21

SET OF STRUCTURAL ELEMENTS MADE UP OF CONCRETE BLOCKS, AND A GRAVITY RETAINING WALL ERECTED THEREFROM

The invention relates to a set of structural elements for erecting (gravity) retaining walls from a plurality of concrete blocks located one above the other and one beside the other, adjacent blocks being at least partially secured against displacements relative to one another, and, for this purpose, the blocks having a groove or depression which runs around the blocks, or is located at least on mutually opposite, in particular upper and lower, side surfaces and extends in each case in the plane of the wall, and blocks arranged one above the other and/or one beside the other being connected by means of separate coupling pieces which are inserted into the depressions of adjacent blocks.

It is known, from DD-PS 93 232, to secure blocks, having grooves running around them, relative to one another by means of cross-shaped, T-shaped or Z-shaped connecting pieces. It is thus possible to form a retaining wall which extends in a single, straight line. Deviations from this, for example curves in the retaining wall, are not possible.

The object of the present invention is to provide a set of structural elements, the constituent parts of which form a stable assembly and at the same time permit a flexible configuration of the retaining wall.

The object is achieved according to the invention in that at least part of each coupling piece is designed in the form of a truncated cone, with corresponding cross-sectional shape of the depression. The coupling piece thus has, in its position in the depression, certain degrees of freedom. In particular, a rotation is possible. Consequently, adjacent blocks can be arranged such that they are rotated with respect to one another. Nevertheless, the securing of the assembly, that is to say the blocks in the retaining wall, is maintained. As a limiting case of the truncated-cone form with a cone angle of 0°, that part of the coupling piece which is described as being in the form of a truncated cone may also be rectangular, and thus in the form of a round bar, in cross-section. The same applies for the cross-sectional shape of the depression.

Advantageously, with respect to a parting plane between two blocks, the coupling pieces are designed differently such that an anchoring piece—as part of the coupling piece—directed towards one block is in the form of a truncated cone and can rotate in the associated depression, and an anchoring piece directed towards an adjacent block is elongate (in the form of a trapezium) and thus cannot rotate in the associated depression. The previously described degrees of freedom are maintained. The coupling piece is prevented from twisting or tilting in the depression.

It is particularly advantageous if the coupling pieces have two different anchoring pieces for insertion into depressions of adjacent blocks, one anchoring piece being designed in the form of a truncated cone with a continuous outer surface and the other anchoring piece being designed as a hollow body with, in particular, intersecting ribs or webs. In the case of blocks located one above the other, the anchoring piece designed as a hollow body comes to be located, in particular, such that it is directed downwards, and thus in an upwardly open depression. Owing to the ribs and webs, material is saved and the weight is reduced, on the one hand. On the other hand, unevennesses in the depression, which are caused, for example, by concrete residues, gravel particles or other elevations, are compensated for. Such dirt or loose parts can, in the case of downwardly directed depressions, fall out as a result of their own weight and be deposited in the upwardly open depressions. In a development of the invention, the anchoring piece designed as a hollow body can be designed such that it is elongate in the direction parallel to the associated depression, in particular with two mutually parallel longitudinal ribs and trapezoidal transverse ribs which intersect said longitudinal ribs. The retaining of the coupling piece in the depression is improved in this manner.

Advantageous developments of the invention are gathered from the subclaims and relate, in particular, to the design and arrangement of the depressions and the configuration of the coupling pieces.

A retaining wall according to Claim 14 and a coupling piece according to Claims 15 to 18 are also included within the context of the invention.

Figure 2:
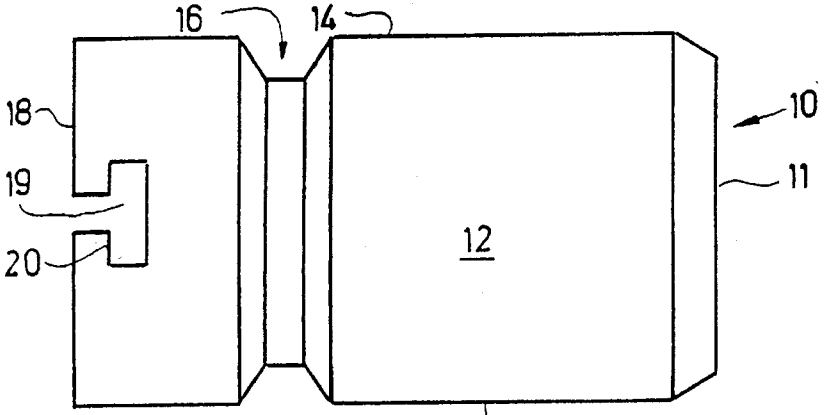
Figure 3:
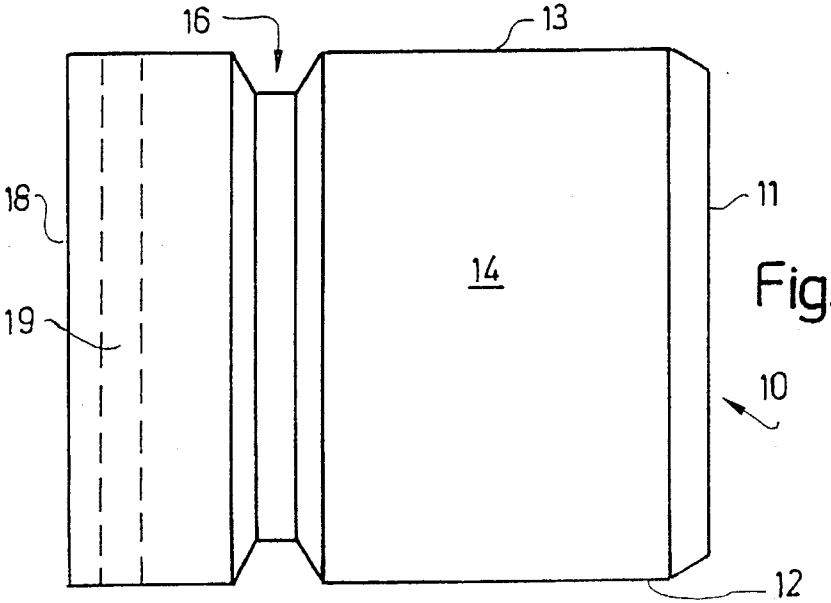
Figure 4C:
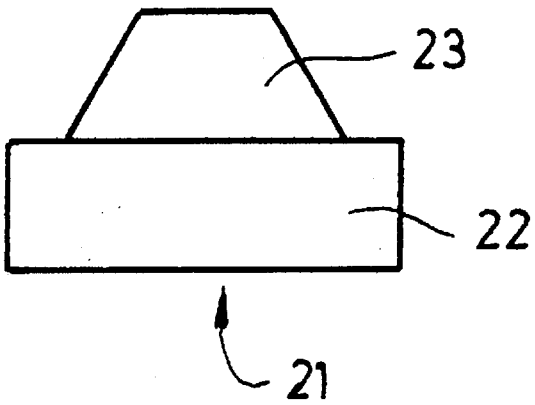
Figure 4B:
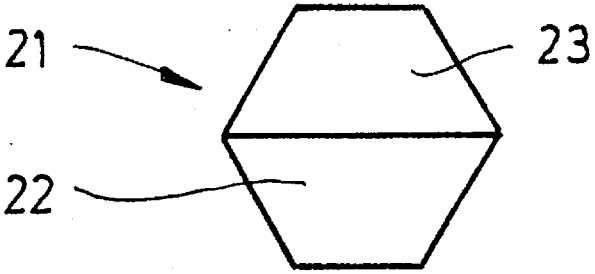
Figure 4A:
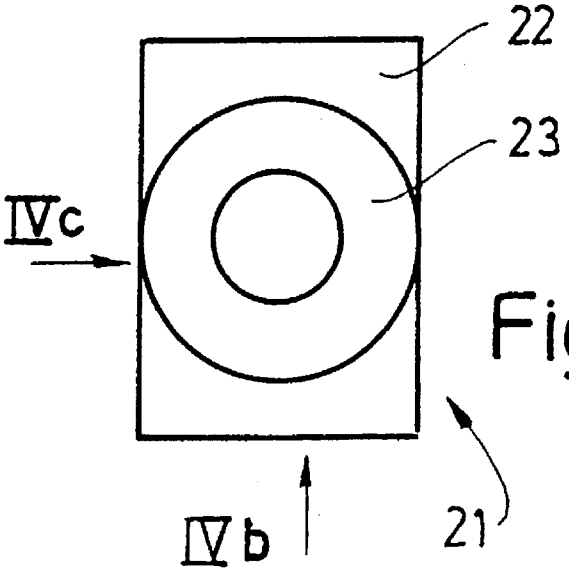
Figures 5A, 5B, 5C, 5D, 6A, 6B, 6C:
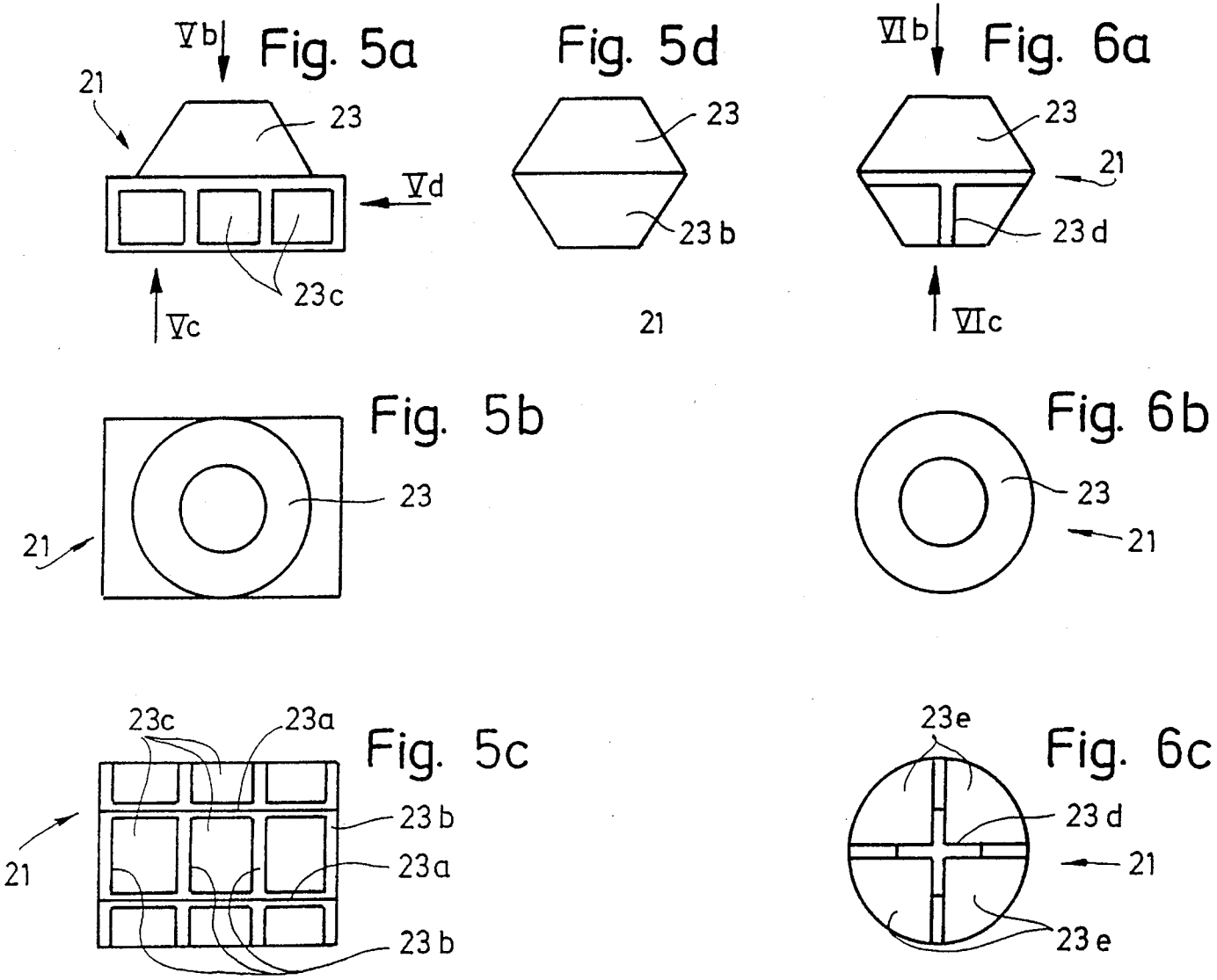
Figure 7A:
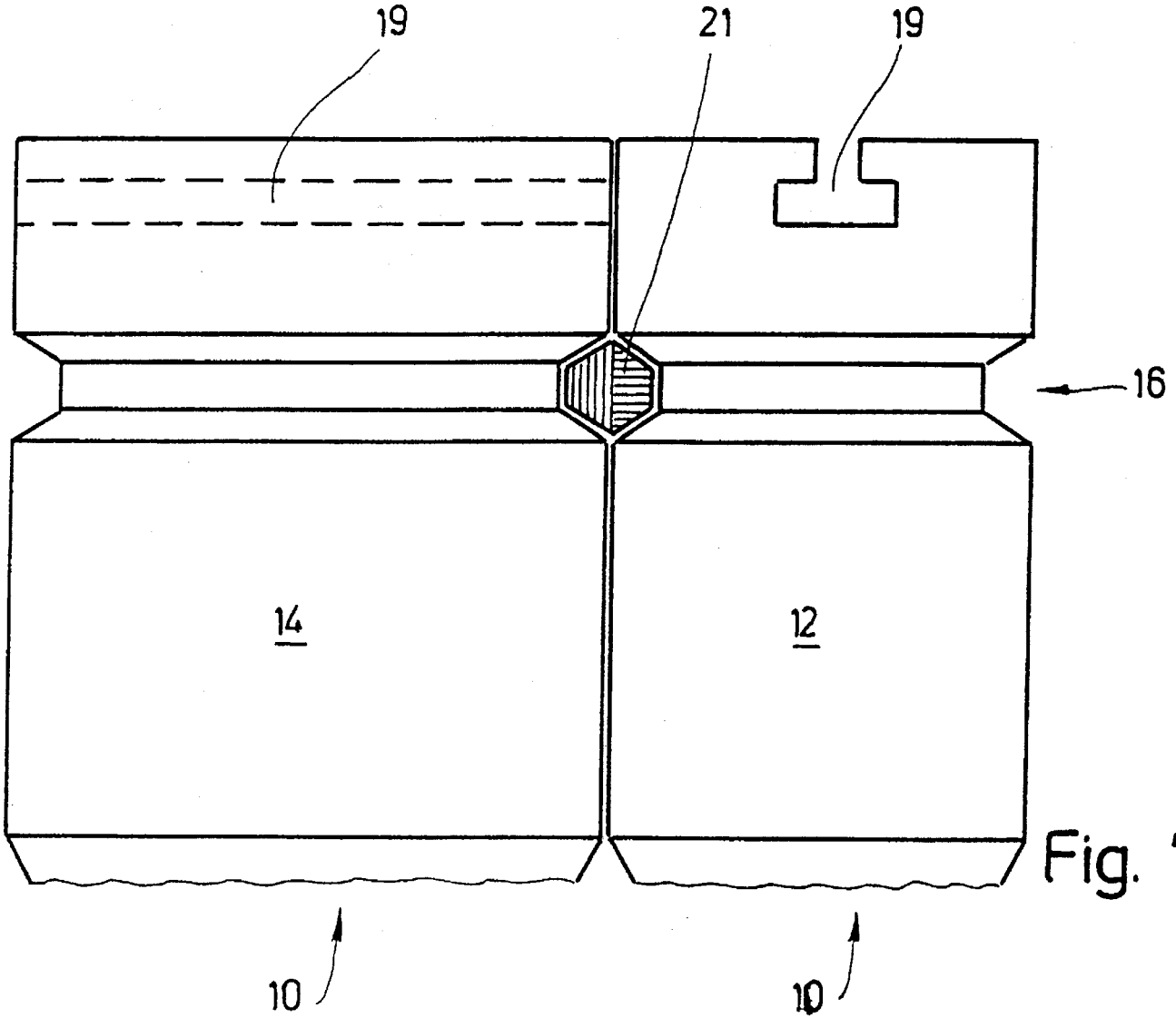
Figure 7B:
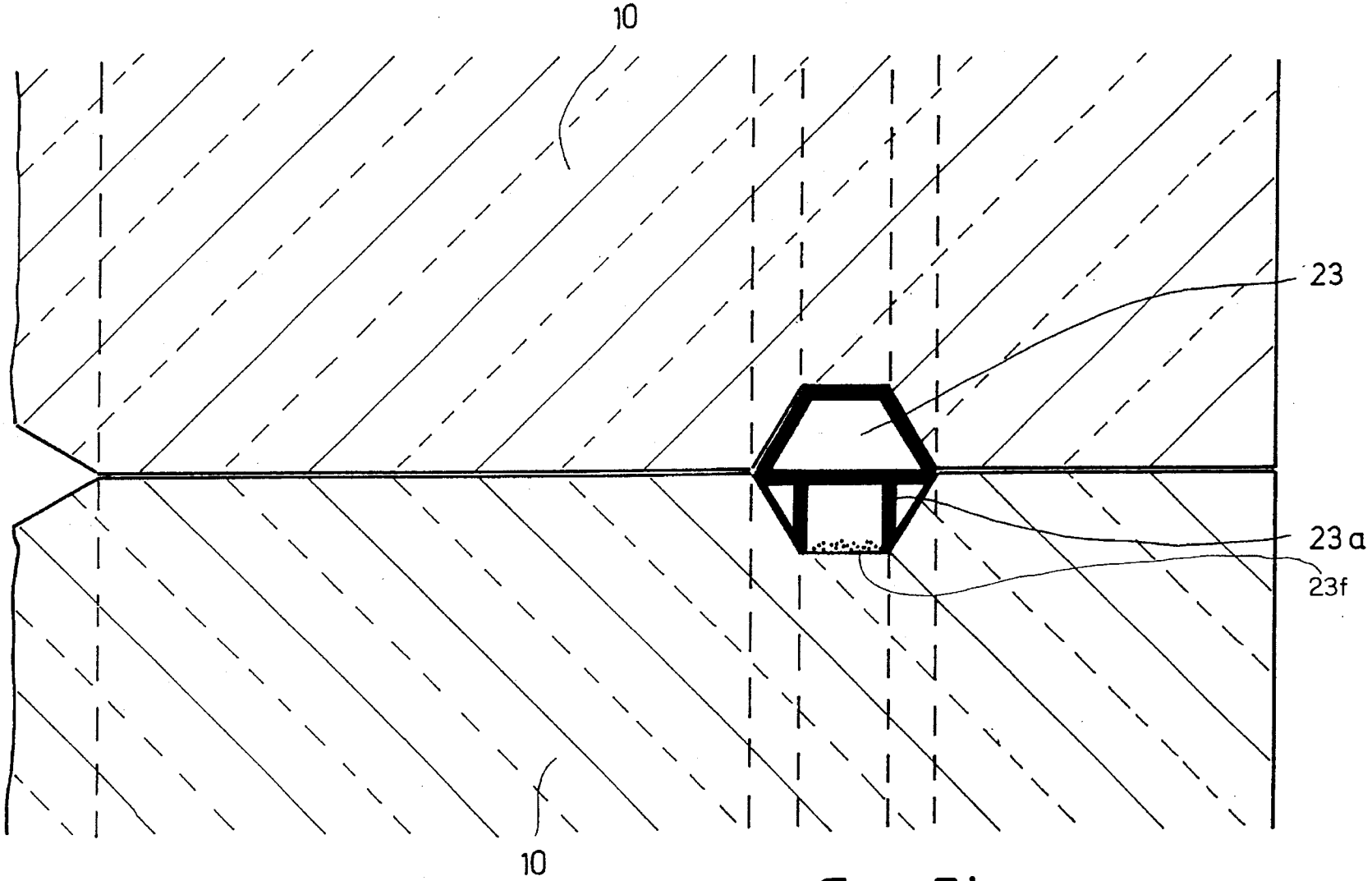
Figure 8:
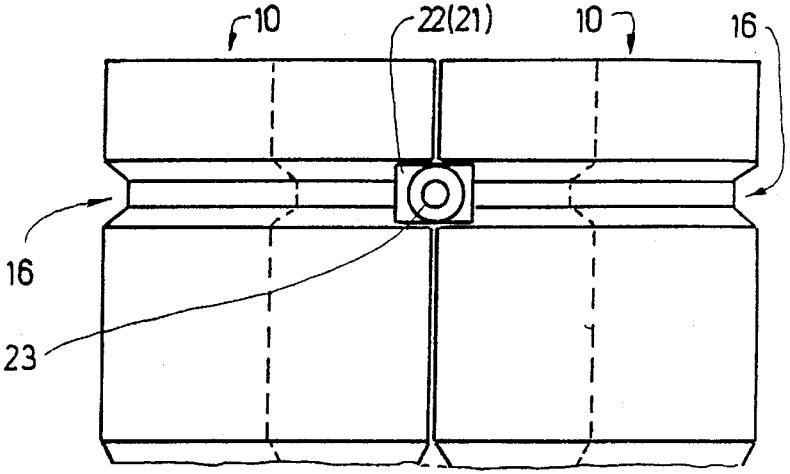
Figure 10:
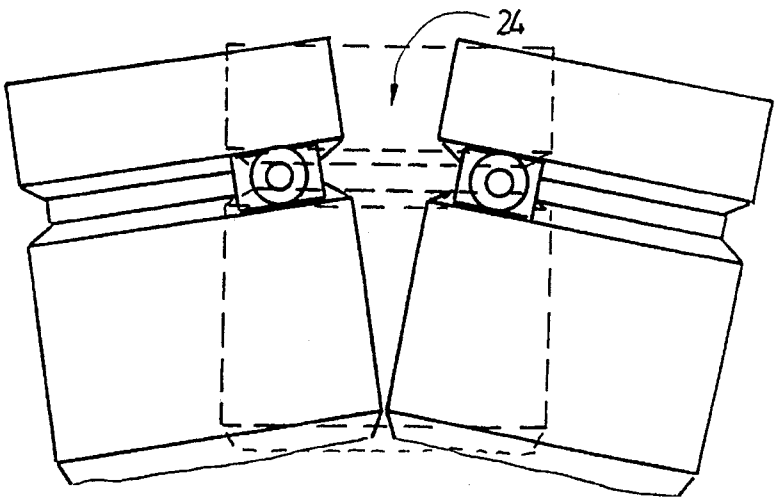
Figure 9:
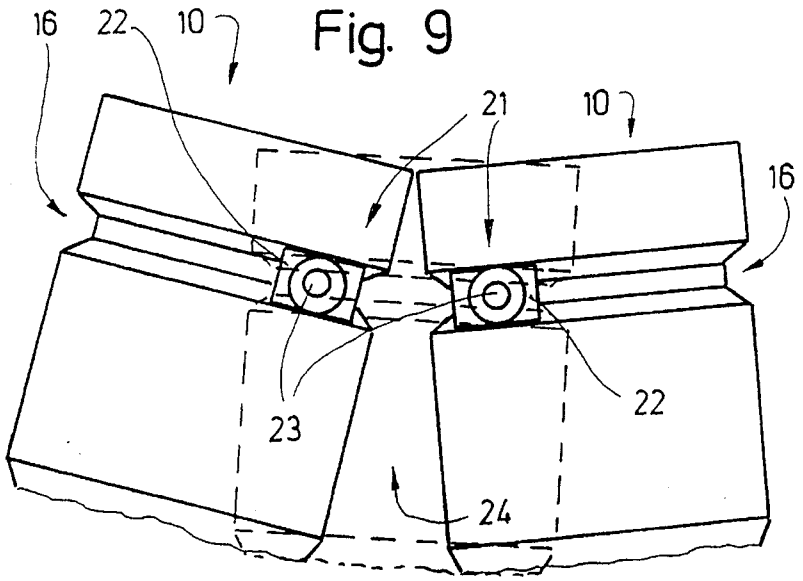
Figure 11:
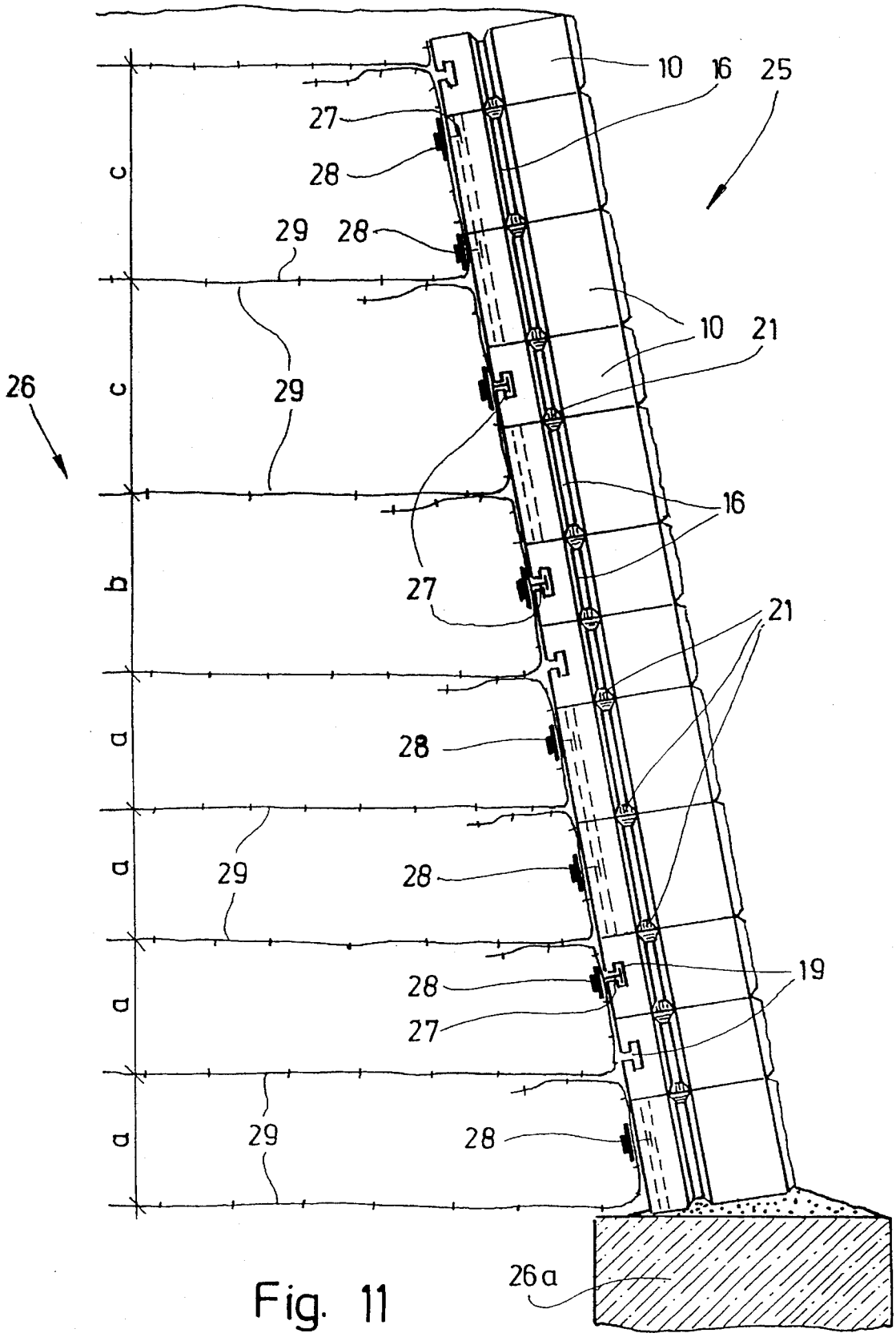
Figure 12:
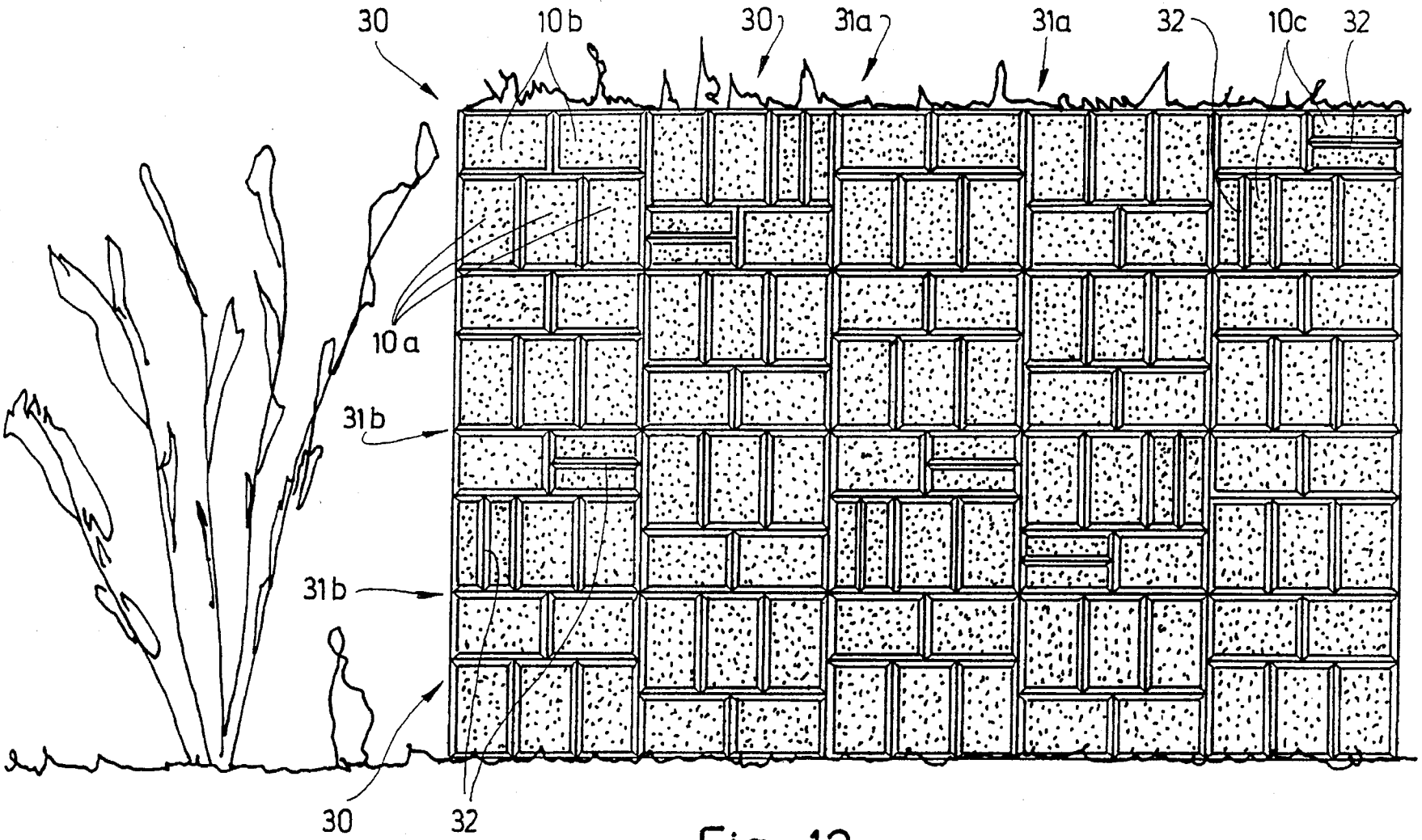
Figure 13:
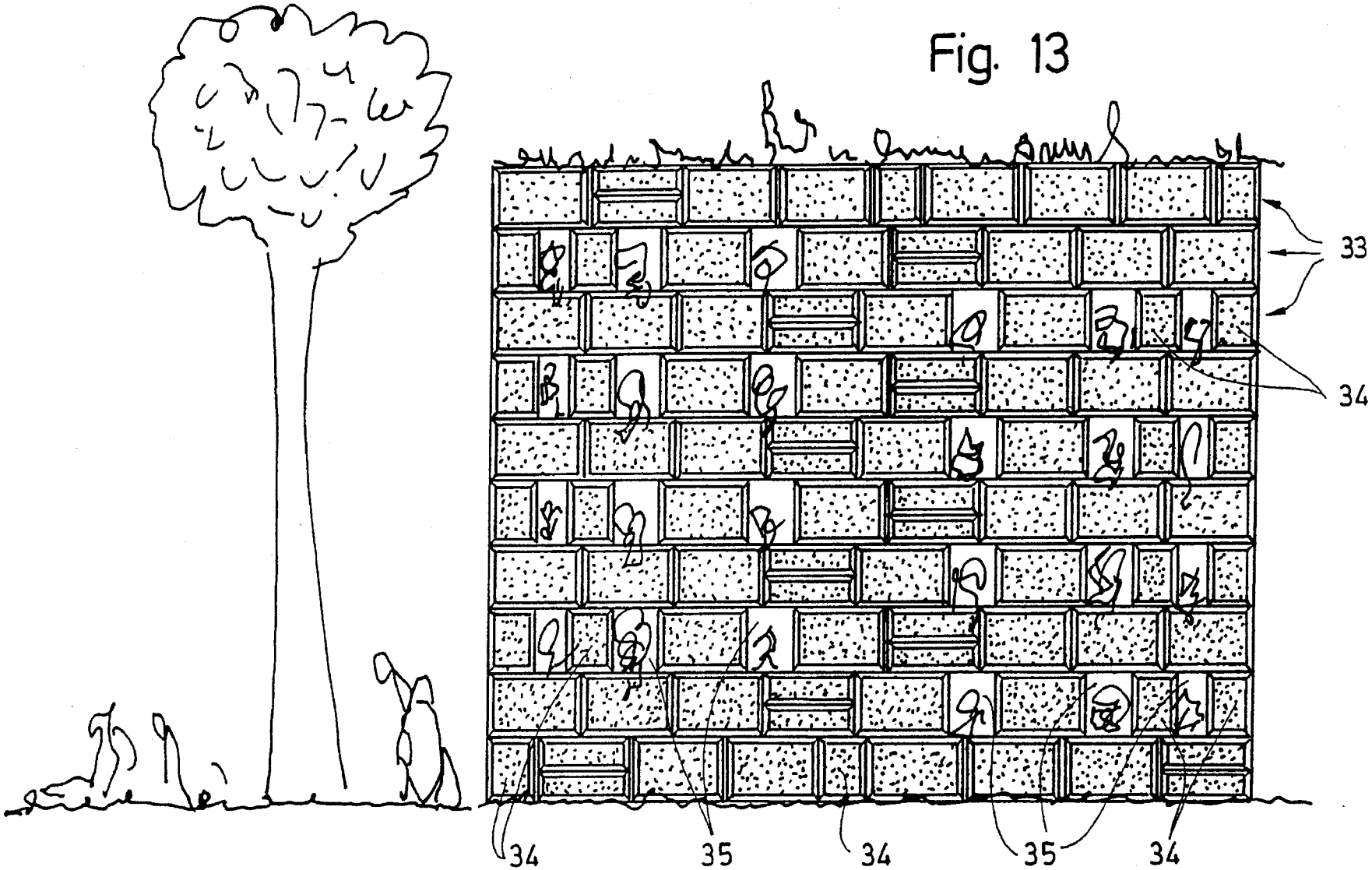
Figure 14:
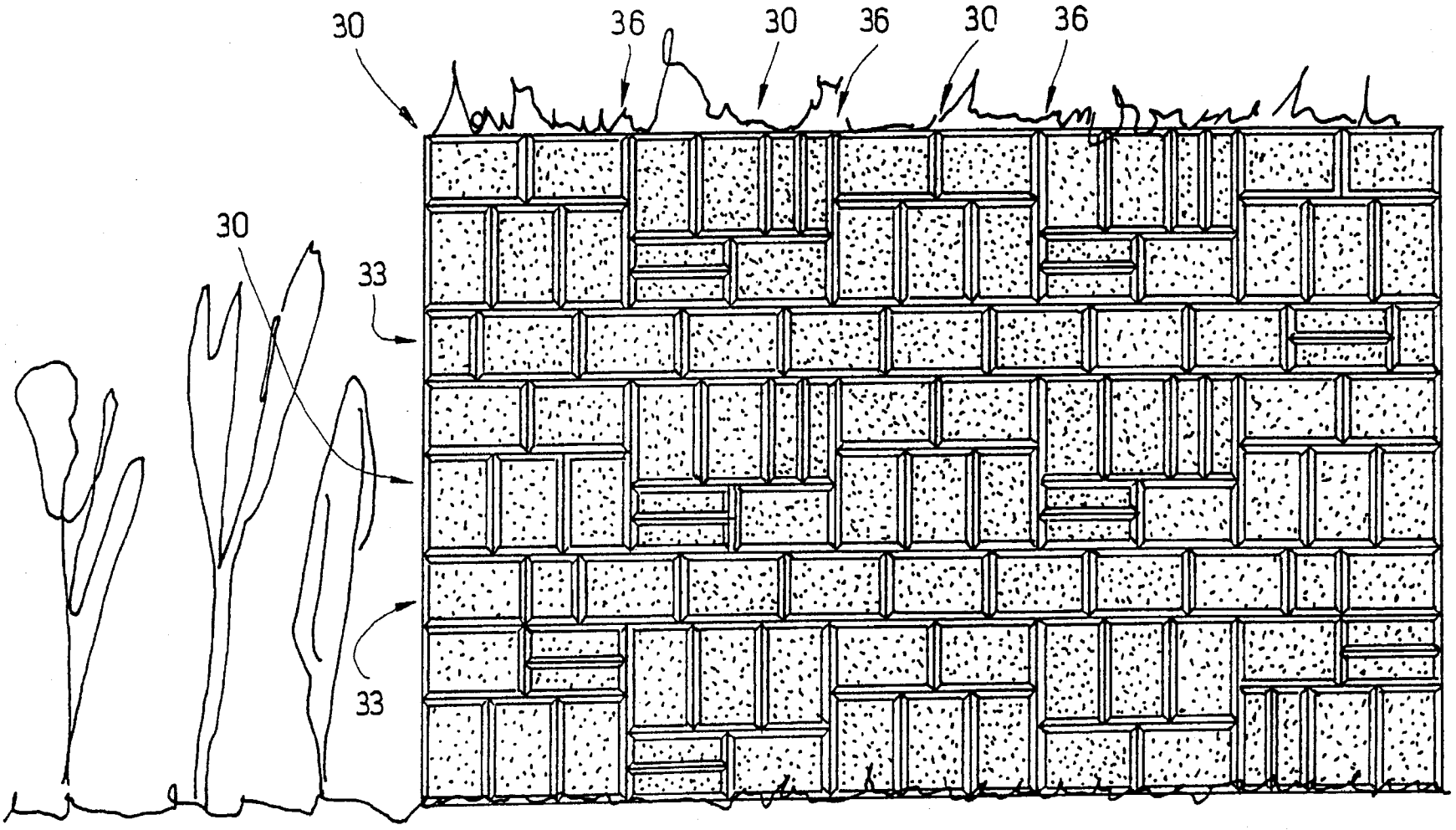

Advantageous embodiments of the invention are illustrated in more detail hereinbelow with reference to drawings, in which:

FIG. 1 shows a front view of a novel block for a set of structural elements according to the invention, FIG. 2 shows a side view of the block according to FIG. 1 in the direction of the arrow II, FIG. 3 shows a plan view of the block according to FIG. 1 in the direction of the arrow III, FIG. 4*a* shows a plan view of a coupling piece, FIG. 4*b* shows a front view of the coupling piece according to FIG. 4*a* in the direction of the arrow IVb, FIG. 4*c* shows a side view of the coupling piece according to FIG. 4*a* in the direction of the arrow IVc, FIG. 5*a* shows a side view of a different embodiment of a coupling piece, FIG. 5*b* shows a plan view of the coupling piece according to FIG. 5*a*, FIG. 5*c* shows a bottom view of the coupling piece according to FIG. 5*a*, FIG. 5*d* shows an end-side view of the coupling piece according to FIG. 5*a*, FIG. 6*a* shows a side view of a further embodiment of a coupling piece, FIG. 6*b* shows a plan view of the coupling piece according to FIG. 6*a*, FIG. 6*c* shows a bottom view of the coupling piece according to FIG. 6*a*, FIG. 7*a* shows two blocks which rest on one another and are secured against displacement by means of a coupling piece, FIG. 7*b* shows two blocks, which rest on one another, in cross-section, similar to FIG. 7*a*, with a coupling piece corresponding to FIGS. 5*a* to 5*d*, FIG. 8 shows a representation of three blocks secured by a coupling piece, FIGS. 9 and 10 show a representation of blocks, arranged in an arcuate manner, with a further block, located over a wide-open gap, and two coupling pieces for connection of the blocks, FIG. 11 shows a retaining wall according to the invention with coupling pieces and anchoring members in cross-section, FIG. 12 shows the front view of a retaining wall according to the invention, FIG. 13 shows the front view of a further embodiment of a retaining wall according to the invention, and FIG. 14 shows a front view of an embodiment of a retaining wall according to the invention.

A novel concrete block 10 for a set of structural elements according to the invention is shown in FIGS. 1 to 3. The basic shape of the block 10 is rectangular with a rectangular front side 11, narrow sides 12, 13 and a wider upper side 14 and wider lower side 15. The sides 12 to 15 are designed, as a whole, to be longer than the front side 11 and each have a depression 16. This runs around the block 10 and is arranged such that it forms a plane which is parallel to the plane of the front side 11. Approximately two thirds of the longitudinal extent of the sides 12 to 15 are located between the front side 11 and the depression 16. An essentially central arrangement is also advantageous.

The depression 16 is designed, in profile, in the form of a trapezium or a V with an outwardly increasing cross-section and can thus be formed at the same time as the block 10 is produced. It is also possible to produce the depression 16 only on some sides, for example on the upper and lower sides 14, 15.

The front side 11 also has, for improved removal from the mould, oblique surfaces 17 running around on the edges.

A rear side 18 opposite the front side 11 has a cutout in the form of a continuous groove 19 with undercuts 20. The cross-sectional profile of the groove 19 is designed, as a whole, in the manner of a hammer head. A dovetail profile is also advantageous. The cross-section increasing towards the centre of the block is important. The groove 19 extends, in a straight line parallel to the upper side 14, over the entire width of the rear side 18. The function is explained in more detail further on in conjunction with FIG. 11.

FIGS. 4*a* to 4*c* show various views of a coupling piece 21. For insertion into the depressions 16 between two adjacent concrete blocks 10, the coupling piece 21 is formed with two halves or anchoring pieces of different cross-section. One anchoring piece, at the bottom in FIG. 4*c* and likewise in FIG. 4*b*, is designed as a bar 22 with trapezoidal profile, while the upper anchoring piece is a truncated cone 23—with an outwardly decreasing cross-section in each case. A virtually playfree connection of the blocks 10 is particularly favourable, the trapezoidal profiles of the depressions 16, of the bar 22 and of the truncated cone 23 corresponding to one another for positively locking engagement. The coupling piece 21 is produced from concrete, advantageously also from plastic—for example as an injection-moulded part.

FIGS. 5*a* to 6*c* show views of two further coupling pieces. In FIGS. 5*a* to 5*d*, the coupling piece 21 is designed with the above-described truncated cone 23 as upper anchoring piece. The lower anchoring piece is, similarly to FIGS. 4*a* to 4*c*, shaped in an elongate manner, but in this case with intersecting longitudinal ribs 23*a* and transverse webs 23*b*. In each case two longitudinal ribs and four transverse webs can be seen in the figures. The longitudinal ribs are designed in a rectangular manner and are offset towards the centre of the anchoring piece and are thus arranged outside the cone region. In contrast, the transverse webs 23*b* are shaped trapezoidally, the outer transverse webs in each case being located on the outermost border of the anchoring or coupling piece. The longitudinal ribs and transverse webs are approximately of the same height. Downwardly (outwardly) open cavities 23*c* are formed between them. On the one hand, material is saved and the overall weight is reduced owing to the ribs and webs. On the other hand, unevennesses in the upper depressions of the lower blocks, which are caused by concrete residues, gravel particles and other elevations, are compensated for. FIGS. 6*a* to 6*c* show a similar coupling piece 21. The upper anchoring piece is again designed as a truncated cone 23 therein. A lower anchoring piece is, in contrast to FIGS. 5*a* to 5*c*, not designed in an elongate manner, but rather, similarly to the truncated cone 23, as a rib cross 23*d*. The intersecting ribs are in each case in the shape of a trapezium and form four cavities 23*e* which are separated from one another.

FIGS. 7*a*, 7*b* show views of two concrete blocks 10 which are connected by coupling pieces 21—corresponding to FIGS. 5*a* to 5*d*. Crumbled concrete 23*f* can be seen between the longitudinal ribs 23*a* in FIG. 7*b*.

In the case of a coupling piece in an embodiment which is not shown, the (upper) anchoring piece is not designed as a truncated cone, but, similarly to the (lower) anchoring piece in FIGS. 5*a* to 6*c*, is designed with ribs and webs.

FIG. 8 shows a view of three blocks 10 which are connected to one another. Successive depressions 16 of adjacent blocks 10 are connected to one another by the bar 22 of the coupling piece 21. The truncated cone 23 is directed out of the plane of the drawing and serves to receive a depression of a block, represented in a broken line, likewise outside the plane of the drawing.

FIGS. 9 and 10 show, as special feature, two concrete blocks 10 which are arranged adjacent to each other, thus forming a gap which is wide open on one side. The gap 24 results in a considerable distance between the blocks 10 in the region of the depressions 16. In FIG. 9, the gap 24 is not quite as large between the blocks in the region of the depressions 16 as in FIG. 10 owing to the off-centre arrangement of the depressions 16 and the oppositely directed tilting in the two figures. Similarly to FIG. 8, a block, located outside the plane of the drawing and drawn in broken lines, is arranged, here too, above two adjacent blocks 10. This block is connected to the blocks located therebeneath by a total of two coupling pieces 21 which are arranged laterally adjacent to its borders. The coupling pieces 21 are located, with their bars 22 in the depressions 16 of the blocks 10 drawn in solid lines. The truncated cones 23 extend in each case into the depression, drawn in broken lines, of the block drawn in broken lines. The special shape of the coupling pieces 21 with bar 22 and truncated cone 23 permits the abovedescribed, angled-off arrangement without the blocks being mutually retained to any lesser extent as a result. A reverse position of time coupling pieces 21, with the bars 22 in the depression of the block drawn in broken lines, is also possible.

A gravity retaining wall 25 erected from a set of structural elements according to the invention can be seen in FIG. 11. Said retaining wall is used for laterally covering or stabilizing an embankment 26. The foundation is designated by 26*a* in FIG. 11. The view in section shows the depressions 16 in the individual blocks 10 as well as the coupling pieces 21 connecting the blocks 10. That side of the retaining wall 25 directed towards the embankment 26 is designated earth side, while the outer side is designated as air side. The blocks 10 are oriented such that the grooves 19, described in conjunction with FIGS. 1 to 3, are directed towards the earth side. In order to increase the structural strength and dimensional stability of the retaining wall 25, anchoring members 27 are inserted into the grooves 19. These are shaped in a manner corresponding to the groove 19, for example with a hammer-head profile, for example hammer-head bolts. On the side directed towards the earth side, connecting pieces 28 are formed, for example as plates which can be fixed against one another and are seated on a pin or a thread. Meshes or grid systems 29 are connected to the anchoring members 27 via the connecting pieces 28. The grid systems 29 do not rot, are resistant to tension, are preferably produced from plastic and are inserted in layers into the embankment when the retaining wall is erected. As a result, the grid systems 29 extend in the horizontal direction. It can be seen from FIG. 11 that the distances of the individual grids from one another increase from bottom to top. The bottom five layers are in each case at a smaller distance a from one another. There then follows thereabove a layer at a somewhat greater distance b, while two layers follow at the top at the greatest distance c. The grid systems 29 are laid such that, starting from the connecting piece 28, they run a little way—approximately half the width of a block—downwards along the retaining wall 25 and are then angled off in the horizontal direction. Preferably, a connection of a grid system to a plurality of blocks 10 arranged one beside the other, parallel to the foundation 26*a*, is provided. In the upper region of the retaining wall 25, the grid system 29 is first of all guided downwards via two blocks 10 and corresponding connecting pieces 28 and is then angled off horizontally.

FIG. 12 shows a finished retaining wall with a special arrangement of the blocks 10. These form rectangular groups 30 of in each case five blocks. Within one group 30, three blocks 10*a* are arranged in an upended manner and two blocks 10*b* are arranged such that they lie transversely. Within the retaining wall, the groups 30 are arranged with external diameters which are aligned with one another, with the result that mutually perpendicular, continuous joints 31*a*, 31*b* are obtained. Within the groups 30, there are arranged some individual blocks 10*c* with specially configured fair faces. In order to produce a structure which is not uniform but which does not appear confused, the fair faces are provided with a continuous V-shaped depression 32 corresponding to the configuration of the oblique surfaces 17. Said depression runs approximately centrally on the front side— also fair face—and approximately parallel to longitudinal edges, corresponding to the upper side 14 and lower side in FIGS. 1 to 3. Provided that there are two blocks with depressions 32 within a group 30, one such block 10*c* is beneath the blocks 10*a* which lie in an upended manner and the other such block is beneath the blocks 10*b* which lie transversely, but the two are not directly adjacent to each other. In FIG. 12, the blocks 10*a*, 10*b* within adjacent groups 30 are arranged such that they are the opposite way round in each case, with the result that the continuous joints 31*b* and 31*a* are obtained only on the outer borders of the groups.

FIG. 13 shows a further special feature. In it, the blocks 10 are arranged such that they lie transversely in horizontal rows 33. Within one row, special blocks can be seen, that is to say blocks of half the length, so-called half-blocks 34. The latter are, in the same way as the full-length block 10 shown in FIGS. 1 to 3, provided with depressions and grooves, which cannot be seen in FIG. 13. The use of the half-blocks 34 permits, in particular, a loosened arrangement for the specific production of planting gaps 35. The half-blocks 34 can also be inserted in a different configuration, for example in a retaining wall according to FIG. 11, 12 or 14.

FIG. 14 relates to an arrangement similar to that in FIG. 12. Individual rows 33 are arranged between individual groups 30. The rows 33 extend in the horizontal direction and separate the groups 30 in the vertical direction. The blocks 10 are located within the rows 33 such that there are no continuous joints, but rather interrupted joints 36, from group 30 to group 30. Consequently, the retaining wall in FIG. 14 has a greater inherent stability than that in FIG. 12.

It can be seen from FIGS. 11 to 14 that the retaining wall 25 is surrounded by earth both at the top and at the bottom.

What is claimed is:

1. A retaining wall (25), made from a plurality of concrete blocks (10, 10*a*, 10*b*, 10*c*, 34) located one beside the other and, at an offset, one on top of another, wherein adjacent ones of said blocks are secured against displacements relative to one another, i.e. transverse to an upright plane of the wall, by means of coupling pieces (21 ), and wherein:

a) the blocks have respective depressions (16), one depression (16) each on mutually opposing upper and lower side faces (14, 15);

b) between superimposed blocks there are disposed said coupling pieces (21) resting in said depressions (16);

c) each of said coupling pieces (21) have two differently designed ends: an upper anchoring piece, which is rotatable in a corresponding depression, and which has a cross-section that is rounded with respect to possible rotation; and a lower elongate anchoring piece; and d) the depressions (16) have cross-sections corresponding to the upper anchoring piece and the lower elongate anchoring pieces of said coupling pieces, at least the depressions (16) which are assigned to said lower elongate anchoring pieces (22) being lower elongate first grooves extending in the plane of said wall, so that said lower elongate anchoring pieces (22) are slidable, but not rotatable, in the corresponding depressions in the plane of the wall in the direction of the length of said lower elongate first grooves.

2. The retaining wall as claimed in claim 1, wherein the depressions assigned to the rotatable upper anchoring pieces (23) are second grooves extending in the plane of the wall.

3. The retaining wall as claimed in claim 2, wherein the said first and second grooves have a trapezoidal cross-section which tapers in the direction of an inside of the respective concrete block.

4. The retaining wall as claimed in claim 2, wherein the concrete blocks, in a continuation of the elongate grooves of said depressions (16) on the upper and lower side faces (14, 15), also have depressions in side faces (12, 13) adjoining said upper and lower side faces, so that a circumferential groove is formed.

5. The retaining wall as claimed in claim 1, wherein said first grooves have a trapezoidal cross-section which tapers in the direction of an inside of the respective concrete block.

6. The retaining wall as claimed in claim 1, wherein said upper and lower anchoring pieces (22, 23) have respective conical cross-sections, i.e., cross-sections tapering towards respective ones of said ends, and wherein the dimensions of the cross-section of said upper and lower anchoring pieces, and of the depressions in the concrete blocks, are adapted to one another for positive fit.

7. The retaining wall as claimed in claim 1, wherein the rotatable upper anchoring piece (23) has a closed outer surface, and wherein the lower elongate anchoring piece (22) has a hollow body with ribs and webs (23*a*, 23*b*, 23*d*), and is open at a bottom thereof.

8. The retaining wall according to claim 7, characterized in that the anchoring piece (22) that has a hollow body is elongate in the direction parallel to the associated depression (16), with two mutually parallel longitudinal ribs (23*a*) and trapezoidal transverse ribs (23*b*) which intersect said longitudinal ribs.

9. The retaining wall according to claim 8, characterized in that the depressions (16) are arranged from approximately centrally of each block to a two-thirds distance away from the front side (11) and a one-third distance away from the rear side (18).

10. The retaining wall according to claim 9, characterized in that the coupling pieces (21) consist of a mouldable, hardened material.

11. The retaining wall according to claim 10, characterized by anchoring members (27) for fixing the retaining wall (25) in aN adjacent earth embankment (26) by means of tension members connected to the anchoring members (27).

12. The retaining wall according to claim 11, characterized in that the blocks (10, . . . ) for receiving the anchoring members (27) have, on one side (18) a cutout (19) which extends at least over a pan-region of the side and has undercuts (20).

13. The retaining wall according to claim 12, characterized in that the cutouts are continuous grooves (19) with a hammer-head profile or dovetail profile.

14. The retaining wall according to claim 13, characterized in that the anchoring members (27) as hammer-head bolts.

15. The retaining wall according to claim 11, characterized in that said tension members connected to the anchoring members (27) form grid systems (29) to be laid in the earth embankment.

16. The retaining wall according to claim 1, characterized in that the coupling pieces (21) are disposed either centrally in the depressions (16) or laterally adjacent to the edges of the blocks (10, . . . ).

17. The retaining wall according to claim 1, characterized in that, in the case of art arrangement of the blocks (10, . . . ) in a row along an arc-shaped line, while forming wide-open gaps (24) between the blocks, two coupling pieces (21) are assigned to each block for connection with a block of an adjacent row, each coupling piece (21) being inserted laterally adjacent to the edges of the blocks.

18. The retaining wall as claimed in claim 1, wherein each rotatable upper anchoring piece (23) has a shape of a truncated cone, and the elongate anchoring pieces (22) are bar-shaped with a trapezoidal cross-section.

19. A set of structural elements for erecting a retaining wall (25) from a plurality of concrete blocks (10, 10*a*, 10*b*, 10*c*, 34) located one beside the other and, at an offset, one on top of another, wherein adjacent ones of said blocks are secured against displacements relative to one another, i.e. transverse to an upright plane of the wall, by means of coupling pieces (21), and wherein:

a) the blocks have respective depressions (16), one depression (16) each on mutually opposing upper and lower side faces (14, 15);

b) between superimposed blocks there are disposed said coupling pieces (21) resting in said depressions (16);

c) each of said coupling pieces (21) have two differently designed ends: an upper anchoring piece, which is rotatable in a corresponding depression, and which has a cross-section that is rounded with respect to possible rotation; and a lower elongate anchoring piece; and d) the depressions (16) have cross-sections corresponding to the upper anchoring piece and the lower elongate anchoring pieces of said coupling pieces, at least the depressions (16) which are assigned to said lower elongate anchoring pieces (22) being lower elongate first grooves extending in the plane of said wall, so that said lower elongate anchoring pieces (22) are slidable, but not rotatable, in the corresponding depressions in the plane of the wall in the direction of the length of said lower elongate first grooves.

20. The set of structural elements as claimed in claim 19, wherein said upper and lower anchoring pieces (22, 23) have respective conical cross-sections, i.e., cross-sections tapering towards respective ones of said ends, and wherein the dimensions of the cross-section of said upper and lower anchoring pieces, and of the depressions in the concrete blocks, are adapted to one another for positive fit.

21. The set of structural elements as claimed in claim 19; wherein each rotatable upper anchoring piece (23) has a shape of a truncated cone, and the elongate anchoring pieces (22) are bar-shaped with a trapezoidal cross-section.

22. A coupling piece for connecting blocks having depressions, in particular for use in a set of structural elements according to claim 19, said coupling space comprising two halves forming two anchoring pieces for insertion into depressions (16) of adjacent blocks (10, . . . ), the halves or anchoring pieces having different cross-sections, wherein the different cross-sections are so designed that the coupling piece (21) in one depression (16), by means of one anchoring piece, can only be displaced, and can rotate in another depression (16) by means of the other anchoring piece.

23. The coupling piece according to claim 22, characterized in that one anchoring piece is designed as a bar (22) with a trapezoidal profile,, and the other anchoring piece is designed as a truncated cone (23).

24. The coupling piece according to claim 23, characterized in that one anchoring piece is designed in the form of a truncated cone with a continuous outer surface, and the other anchoring piece is designed as a hollow body with intersecting ribs or webs (23*a*, 23*b*, 23 *d*).

25. The coupling piece according to claim 24, characterized in that the anchoring piece designed as a hollow body is elongate in the direction parallel to the associated depression, with two mutually parallel longitudinal ribs (23*a*) and trapezoidal transverse ribs (23*b*) which intersect said longitudinal ribs.

* * * * *